US008432418B2

(12) United States Patent
Noguchi et al.

(10) Patent No.: US 8,432,418 B2
(45) Date of Patent: Apr. 30, 2013

(54) SIGNAL PROCESSING DEVICE, SIGNAL PROCESSING METHOD, AND DISPLAY APPARATUS

(75) Inventors: Hideyuki Noguchi, Kanagawa (JP); Takashi Hirakawa, Tokyo (JP)

(73) Assignee: Sony Corporation, Tokyo (JP)

( * ) Notice: Subject to any disclaimer, the term of this patent is extended or adjusted under 35 U.S.C. 154(b) by 1296 days.

(21) Appl. No.: 12/170,897

(22) Filed: Jul. 10, 2008

(65) Prior Publication Data

US 2009/0021537 A1 Jan. 22, 2009

(30) Foreign Application Priority Data

Jul. 17, 2007 (JP) ..... 2007-186269

(51) Int. Cl.
*G09G 5/10* (2006.01)

(52) U.S. Cl.
USPC ..... 345/690; 345/82; 345/89; 345/204; 345/88

(58) Field of Classification Search ..... 345/76–83, 345/89, 204, 690, 88
See application file for complete search history.

(56) References Cited

U.S. PATENT DOCUMENTS

| | | | | |
|---|---|---|---|---|
| 7,176,938 | B2 * | 2/2007 | Feng | 345/600 |
| 2007/0008251 | A1 * | 1/2007 | Kohno et al. | 345/76 |
| 2007/0210996 | A1 * | 9/2007 | Mizukoshi et al. | 345/77 |
| 2007/0290958 | A1 * | 12/2007 | Cok | 345/77 |

FOREIGN PATENT DOCUMENTS

| | | |
|---|---|---|
| JP | 2000-321559 | 11/2000 |
| JP | 2005-202377 | 7/2005 |
| JP | 2005-352443 | 12/2005 |
| JP | 2006-003880 | 1/2006 |
| JP | 2006-023710 | 1/2006 |

OTHER PUBLICATIONS

Japanese Office Action issued on Feb. 21, 2012, in connection with counterpart JP Application No. 2007-186269.

* cited by examiner

*Primary Examiner* — Lun-Yi Lao
*Assistant Examiner* — Sosina Abebe
(74) *Attorney, Agent, or Firm* — Dentons US LLP

(57) ABSTRACT

A signal processing device for supplying a drive voltage signal to a display panel, includes a luminance detector, a memory to store a first correction factor for correcting the luminance level of the pixel to be changed by a voltage level difference between a drive voltage signal supplied to the display element and a drive voltage signal supplied to a first adjacent display element adjacent to the display element in the forward direction of the scanning line, and a second correction factor for correcting the luminance level of the pixel to be changed by a voltage level difference between a drive voltage signal supplied to the display element and a second adjacent display element adjacent to the display element in the reverse direction of the scanning line, a correction voltage level computing unit, and an adder to add the first correction voltage level and the second correction voltage level.

10 Claims, 11 Drawing Sheets

SIGNAL PROCESSING DEVICE, SIGNAL PROCESSING METHOD, AND DISPLAY APPARATUS

CROSS-REFERENCE TO RELATED APPLICATIONS

The present application claims benefit of priority of Japanese patent Application No. 2007-186269 filed in the Japanese Patent Office on Jul. 17, 2007, the entire disclosure of which is incorporated herein by reference.

BACKGROUND OF THE INVENTION

1. Field of the Invention

The present invention relates to a signal processing device for supplying a drive voltage signal to a display panel having two opposing substrates provided with electrodes, at least one of the substrates being transparent, and having a plurality of display elements arranged along a predetermined scanning line which are driven by the drive voltage signal applied between the electrodes. The present invention also relates to a signal processing method.

2. Description of Related Art

A general liquid crystal display panel includes a plurality of liquid crystal elements, each composed of pixel electrodes mounted on a first substrate, a common electrode mounted on a second substrate opposed to the first substrate, and a dielectric anisotropic liquid crystal layer held between the pixel electrodes and the common electrode. Each liquid crystal element changes the transmittance of light passing through the liquid crystal layer by changing the strength of the electric field between the pixel electrodes and the common electrodes in response to the voltage level of a drive voltage signal. The liquid crystal display panel is driven to display a desired image on the respective liquid crystal elements by adjusting the voltage levels applied to the pixel electrodes and the common electrode, respectively.

In such a liquid crystal display panel, the high luminance and high resolution of display images can be attained by decreasing the distance between the adjacent liquid crystal elements within the panel. However, the following problem may occur when the distance between the adjacent liquid crystal elements is decreased in the liquid crystal display panel. That is, depending on the voltage level difference between the drive voltage signals supplied to the adjacent liquid crystal elements, the electric field disturbance occurs at the liquid crystal layer and the light transmittance is changed correspondingly, thus deteriorating the quality of images to be displayed.

Among various liquid crystal display panels, a single-panel type liquid crystal display panel in which liquid crystal elements for displaying red light, liquid crystal elements for displaying green light, and liquid crystal elements for displaying blue right are arranged along a scanning line has different characteristics in the liquid crystal layers of the adjacent liquid crystal elements. As a result, the electric field disturbance causes on the respective liquid crystal elements, as shown in FIGS. 11A and 11B.

FIGS. 11A and 11B show schematically the cross-sectional shapes of the single-plate type liquid crystal display panel, in which liquid crystal elements G for displaying green light, liquid crystal elements B for displaying blue light, and liquid crystal elements R for displaying red light are arranged along the scanning line, respectively. FIGS. 11A and 11B also show schematically curves E1 and E2 indicating the electric field strength according to the position of the scanning line, together with the liquid crystal orientation in the individual liquid crystal elements. These liquid crystal elements arranged in the liquid crystal display panel are designed so that the luminance level is lowered from the maximum value to the minimum value as the voltage value applied is changed from 0V to 5V.

The liquid crystal display panel is usually set so as to achieve a good white display. Therefore, upon the application of the voltage of, for example, 2V to all of the liquid crystal elements G, B, and R, as represented by the curve E1 in FIG. 11A, the orientations of the entire liquid crystal layers of the respective liquid crystal elements can be changed substantially uniformly so that the pixels corresponding to these liquid crystals can display the desired gray.

However, when the drive voltage level applied to the liquid crystal elements G is set to 5V, and the drive voltage levels applied to the liquid crystal elements R and B adjacent to the liquid crystal element G are set to 2V, respectively, as represented by the curve E2 in FIG. 11B, the electric field disturbance occurs at the respective liquid crystal elements of the liquid crystal display panel due to the following causes.

Specifically, due to the influence of the electric field of the liquid crystal element G adjacent to the reverse direction of the scanning line, the liquid crystal elements B shown in FIG. 11B have lower electric field strength at a range W1 adjacent to the liquid crystal element G, than the liquid crystal element B shown in FIG. 11A. Consequently, the pixel luminance level to be displayed by the liquid crystal element B shown in FIG. 11B is higher than that displayed by the liquid crystal element B shown in FIG. 11A. On the other hand, due to the influence of the electric field of the liquid crystal element G adjacent to the forward direction of the scanning line, the liquid crystal element R shown in FIG. 11B have higher electric field strength at a range W2 adjacent to the liquid crystal element G, than the liquid crystal elements B shown in FIG. 11A. Consequently, the pixel luminance level to be displayed by the liquid crystal element R shown in FIG. 11B is higher than that displayed by the liquid crystal element G shown in FIG. 11A.

The degree to which the liquid crystal orientation is disturbed by the electric field strength of the adjacent liquid crystal elements becomes higher with decreasing the distance between the adjacent liquid crystal elements, particularly.

Japanese Unexamined Patent Application Publication No. 2005-352443 discloses a liquid crystal display apparatus that corrects the luminance level of a pixel by referring to the luminance level of the adjacent pixel along the scanning line of the pixel. In the liquid crystal display apparatus, for example, the luminance level of the liquid crystal element B shown in FIG. 10B cannot be corrected properly because the correction is made by referring to the luminance level of the pixel adjacent to one direction, in other words, the correction is not made by referring to the luminance level of the pixel adjacent to the reverse direction of the scanning line.

Japanese Unexamined Patent Application Publication No. 2000-321559 discloses a display apparatus that corrects the image signal of a pixel by referring to the image signals of two adjacent pixels in the forward and reverse directions of the scanning line of the pixel, respectively. In the display apparatus, the correction is made by considering similarly the influences of the adjacent pixels, irrespective of whether the adjacent pixel is positioned in the forward or reverse direction with respect to the pixel. Accordingly, when the array of the liquid crystal elements within the panel is laterally asymmetric, and when the liquid crystal elements control the liquid crystal orientation including the tilt angle, the degree to which the liquid crystal orientation is disturbed by the voltage level difference between the adjacent liquid crystal elements varies depending on the direction in which the adjacent pixel is adjacent. It is therefore difficult to properly correct the luminance level.

As the display panel having two opposing substrates provided with electrodes, at least one of the substrates being transparent, and having a plurality of display elements arranged along a predetermined scanning line which are driven by the drive voltage signal applied between the electrodes, there are, besides the liquid crystal display panels described above, those in which the luminance level displayed by a display element vary depending on the signal level of a drive voltage signal supplied to the adjacent display element.

SUMMARY OF THE INVENTION

It is desirable to provide a signal processing device and a signal processing method which are capable of reducing image quality deterioration by properly correcting the luminance level of a pixel even when the luminance level change of the pixel caused by the voltage level difference between the adjacent display elements arranged on a display panel varies depending on whether the display elements are adjacent to the forward or reverse direction of a scanning line.

In accordance with an aspect of the present invention, a signal processing device for supplying a drive voltage signal to a display panel, the display panel including two substrates which oppose each other, electrodes disposed on the respective two substrates, and a plurality of display elements arranged along a scanning line and driven by the drive voltage signal supplied to the electrodes, at least one of the two substrates being transparent, which includes: input means, luminance detecting means, storing means, selecting means, differential computing means, correction voltage level computing means, and adding means. The input means inputs the drive voltage signal. The luminance detecting means detects, from a drive voltage signal supplied to a display element inputted by the input means, a luminance level of a pixel displayed by the display element. The storing means stores a first correction factor for correcting the luminance level of the pixel to be changed by a voltage level difference between a drive voltage signal supplied to the display element and a drive voltage signal supplied to a first adjacent display element adjacent to the display element in the forward direction of the scanning line, and a second correction factor for correcting the luminance level of the pixel to be changed by a voltage level difference between a drive voltage signal supplied to the display element and a second adjacent display element adjacent to the display element in the reverse direction of the scanning line. The selecting means selects from the store means a first correction factor and a second correction factor in accordance with a luminance level of a pixel detected by the luminance detecting means. The differential computing means computes, from a drive voltage signal inputted by the input means, a first voltage level difference indicating a voltage level difference between a drive voltage signal supplied to the display element and a drive voltage signal supplied to the first adjacent display element, and a second voltage level difference indicating a voltage level difference between a drive voltage signal supplied to the display element and a drive voltage signal supplied to the second adjacent display element. The correction voltage level computing means computes a first correction voltage level from the first correction factor selected by the selecting means and the first voltage level difference computed by the differential computing means, and a second correction voltage level from the second correction factor selected by the selecting means and the second voltage level difference computed by the differential computing means. The adding means adds the first correction voltage level and the second correction voltage level computed by the correction voltage level computing means to the voltage level of a drive voltage signal to be supplied to the display element inputted by the input means, and supplies the resulting level to the display element of the display panel.

In accordance with another aspect of the present invention, a signal processing method of supplying a drive voltage signal to a display panel having two opposing substrates, at least one of the substrates being transparent, and having a plurality of display elements arranged along a predetermined scanning line and driven by the drive voltage signal applied to the electrodes, is provided which includes: an inputting step, a detecting step, a selecting step, a differential computing step, a correction voltage level computing step, and an adding step. The inputting step inputs the drive signal by input means. The detecting step detects, from a drive voltage signal to be supplied to a display element inputted by the inputting step, a luminance level of the pixel displayed by the display element. The selecting steps selects a first correction factor and a second correction factor in accordance with the luminance level of a pixel detected by the luminance level detecting step, from a memory storing a first correction factor for correcting the luminance level of the pixel to be changed by a voltage level difference between a drive voltage signal supplied to the display element and a drive voltage signal supplied to a first adjacent display element adjacent to the display element in the forward direction of the scanning line, and a second correction factor for correcting the luminance level of the pixel to be changed by a voltage level difference between a drive voltage signal supplied to the display element and a second adjacent display element adjacent to the display element in the reverse direction of the scanning line. The differential computing step computes, from a drive voltage signal inputted by the input means, a first voltage level difference indicating a voltage level difference between a drive voltage signal to be supplied to the display element and a drive voltage signal supplied to the first adjacent display element, and a second voltage level difference indicating a voltage level difference between a drive voltage signal supplied to the display element and a drive voltage signal supplied to the second adjacent display element. The correction voltage computing step computes a first correction voltage level from the first correction factor selected by the selecting step and the first voltage level difference computed by the differential computing step, and a second correction voltage level from the second correction factor selected by the select step and the second voltage level difference computed by the differential computing step. The adding step adds the first correction voltage level and the second correction voltage level computed by the correction voltage level computing step, to the voltage level of a drive voltage signal supplied to the display element inputted by the input means, and supplies the resulting level to the display element of the display panel.

According to an embodiment of the present invention, even when the luminance level change of the pixel caused by the voltage level difference between the adjacent display elements arranged on the display panel varies depending on whether these display elements are adjacent to the forward or reverse direction of the scanning line, the first correction voltage level is computed from the relationship with the first adjacent display element adjacent to the forward direction of the scanning line, and the second correction voltage level is computed from the relationship with the second adjacent display element adjacent to the reverse direction of the scanning line, and the drive voltage signal of the voltage level obtained by adding the first and second correction voltage levels is supplied to the display element. This permits proper correction of the luminance level change of the pixel, thereby reducing image quality deterioration.

The above summary of the present invention is not intended to describe each illustrated embodiment or every implementation of the present invention. The figures and the detailed description which follow more particularly exemplify these embodiments.

DETAILED DESCRIPTION OF EMBODIMENTS

A signal processing device, to which an embodiment of the present invention is applied, supplies a drive voltage signal to a display panel having two opposing substrates provided with electrodes, at least one of the substrates being transparent, and having a plurality of display elements arranged along a predetermined scanning line driven by the drive voltage signal applied to the electrodes.

Figure 1:
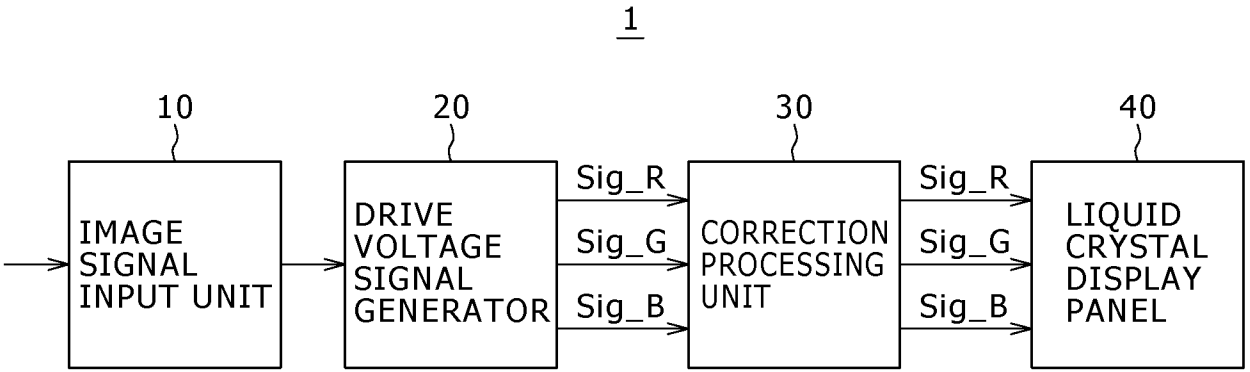
FIG. 1 is a drawing schematically showing the overall configuration of a display apparatus.

As an example of the display apparatus incorporating the signal processing device, a liquid crystal display apparatus 1 as shown in FIG. 1 is used to describe an embodiment of the present invention.

The liquid crystal display apparatus 1 includes a so-called single-plate type liquid crystal display panel 40, in which liquid crystal elements R for displaying red light, liquid crystal elements G for displaying green light, and liquid crystal elements B for displaying blue light are arranged on a single liquid crystal display panel.

Figure 2:
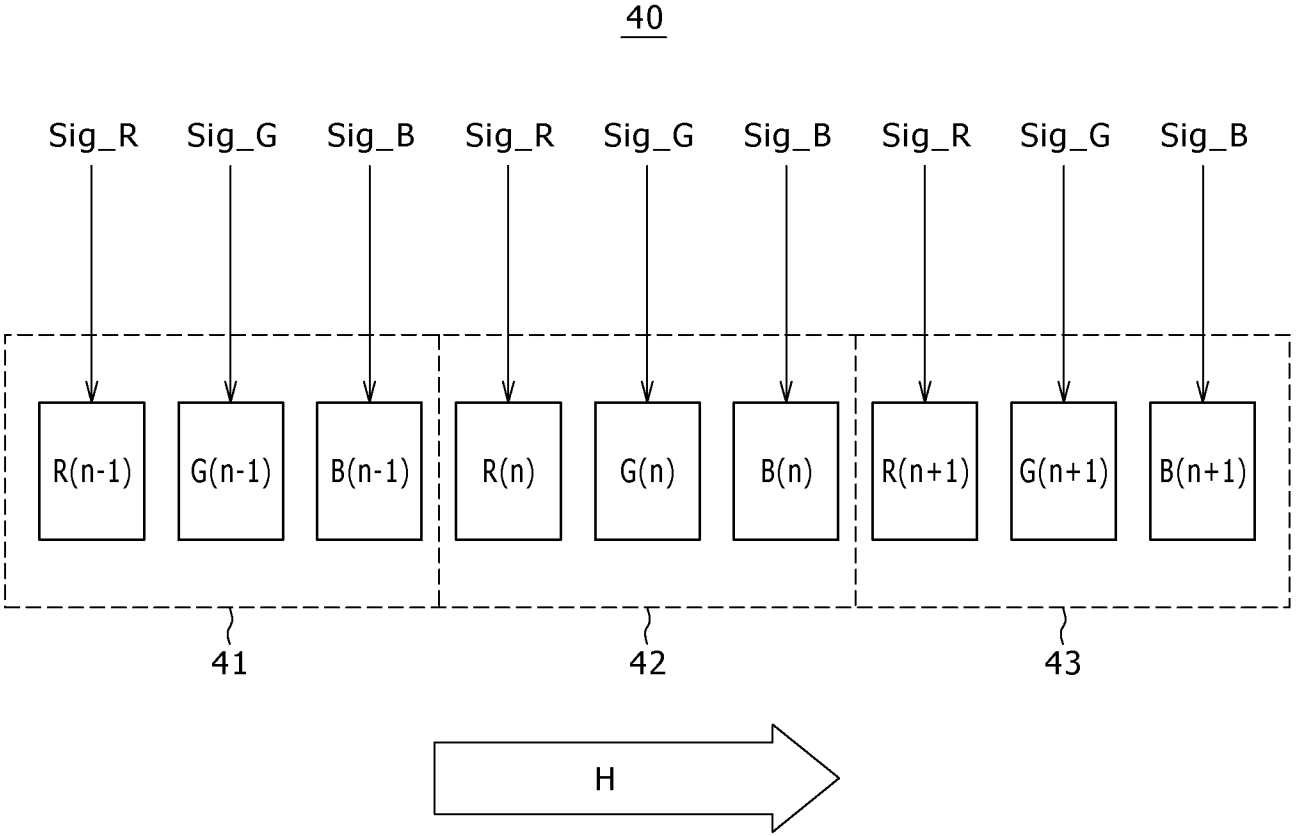
FIG. 2 is a drawing showing schematically the array configuration of liquid crystal elements arranged on a single-plate type liquid crystal display panel.

The liquid crystal panel 40 includes pixel regions 41, 42, and 43 which are arranged along the forward direction H of a predetermined scanning line, as shown in FIG. 2. The pixel region 41 includes a liquid crystal element R(n−1) for displaying red light, a liquid crystal element G(n−1) for displaying green light, and a liquid crystal element B(n−1) for displaying blue light (n is a natural number). The pixel region 42 includes a liquid crystal element R(n) for displaying red light, a liquid crystal element G(n) for displaying green light, and a liquid crystal element B(n) for displaying blue light. The pixel region 43 includes a liquid crystal element R(n+1) for displaying red light, a liquid crystal element G(n+1) for displaying green light, and a liquid crystal element B(n+1) for displaying blue light.

In the liquid crystal display panel 40 with the liquid crystal elements thus arranged, drive voltage signals are supplied from a correction processing unit 30 described later to the pixel region 41, the pixel region 42, and the pixel region 43 in the order named.

That is, in the liquid crystal display panel 40, three-phase drive voltage signals are supplied to the respective liquid crystal elements R(n−1), G(n−1), and B(n−1) in the pixel region 41 at a first timing, and supplied to the respective liquid crystal elements R(n), G(n), and B(n) in the pixel region 42 at a second timing, and supplied to the respective liquid crystal elements R(n+1), G(n+1), and B(n+1) in the pixel region 43 at a third timing. Subsequently, these signals are supplied to the liquid crystal elements of the pixel regions arranged along the scanning line, respectively.

The liquid crystal display panel 40, in which the drive voltage signals are supplied to the respective liquid crystal elements in this manner, is capable of displaying the image in response to signals by using the drive voltage signals sequentially supplied to the liquid crystal elements arranged along the scanning line, respectively.

For supplying the drive voltage signals to the liquid crystal display panel 40 thus configured, the liquid crystal display apparatus 1 has an image signal input unit 10 to input image signals from the outside, a drive voltage signal generator 20 to generate a drive voltage signal for driving the liquid crystal elements in response to image signals, and a correction processing unit 30 to correct the voltage level of the drive voltage signal.

The image signal input unit 10 inputs from the outside, for example, via a predetermined interface, image signals in a digital format, and supplies the input image signals to the drive voltage signal generator 20.

The drive voltage signal generator 20 generates three-phase drive voltage signals Sig_R, Sig_G, and Sig_B from the image signals supplied from the image signal input unit 10, in order to simultaneously drive the respective liquid crystal elements R, G, and B provided in the corresponding pixel regions on the liquid crystal display panel 40, and supplies the generated three-phase drive voltage signals Sig_R, Sig_G, and Sig_B to the correction processing unit 30 at predetermined output timings, respectively.

Here, the drive voltage signal generator 20 generates drive voltage signals, to which voltage levels, for example, from 0V to 5V with respect to the common electrodes of the liquid crystal panel 40 are set as the luminance level indicated by the image signal becomes higher.

The correction processing unit 30 performs correction processing described later to the three-phase drive voltage signals Sig_R, Sig_G, and Sig_B supplied from the drive voltage signal generator 20, and supplies the corrected three-phase drive voltage signals Sig_R, Sig_G, and Sig_B to the liquid crystal display panel 40.

In the liquid crystal display apparatus 1 having the above configuration, in accordance with the operation characteristics of the liquid crystal elements arranged on the liquid crystal display panel 40, the correction processing unit 30 performs processing of correcting the voltage levels of the drive voltage signals Sig_R, Sig_G, and Sig_B to be supplied to the corresponding liquid crystal elements so as to attain the luminance levels indicated by the drive voltage signals Sig_R, Sig_G, and Sig_B, respectively.

Prior to the descriptions of the specific configuration of the correction processing unit 30 and the operation thereof, the cause that the liquid crystal orientation is disturbed when the adjacent liquid crystal elements have different voltage levels of the drive voltage signals is described with reference to FIGS. 3A and 3B.

Figure 3A:
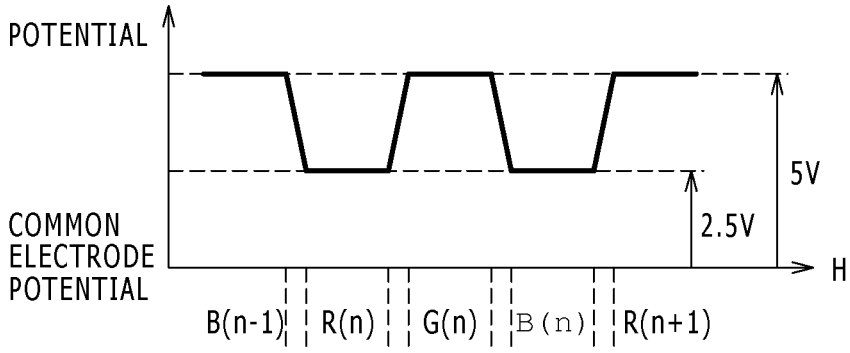
FIGS. 3A and 3B are charts for explaining the main causes of the luminance level change of a pixel due to the voltage level difference between drive voltage signals supplied to adjacent liquid crystal elements.
Figure 3B:
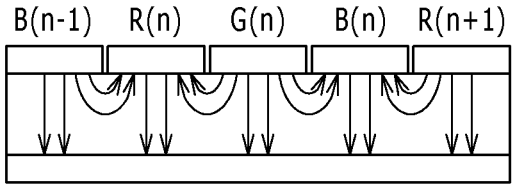

FIG. 3A is a chart on which the abscissa represents the positions on the scanning line arranged in the following order: the liquid crystal elements B(n−1), R(n), G(n), B(n) and R(n+1), and the ordinate represents the voltage levels held by the respective liquid crystal elements when a drive voltage signal having a voltage level of 5V is supplied to the liquid crystal elements B(n−1), G(n), and R(n+1) and a drive voltage signal having a voltage level of 2.5V is supplied to the liquid crystal elements R(n) and B(n).

Here, the liquid crystal element R(n) is focused attention. The difference between the voltage level held by the liquid crystal element R(n) and the voltage level held by the liquid crystal element B(n−1) adjacent to the reverse direction of the scanning line is 2.5V. The difference between the voltage level held by the liquid crystal element R(n) and that held by the liquid crystal element G(n) adjacent to the forward direction of the scanning line is 2.5V. Accordingly, the disturbance as indicated by the arrows in FIG. 3B occurs in the electric field of the liquid crystal layer of the liquid crystal element R(n). That is, in the liquid crystal within the liquid crystal element R(n), the electric field disturbance becomes greater with decreasing distance to the surroundings of this liquid crystal element. The liquid crystal orientation is also disturbed by the electric field disturbance, failing to drive so that the luminance level of the pixel displayed by the liquid crystal element R(n) can have the desired value.

The liquid crystal element R(n) has the voltage level difference of 2.5V with respect to both of the two adjacent liquid crystal elements B(n−1) and G(n). These two adjacent liquid crystal elements B(n−1) and G(n) display different colors and therefore have different operation characteristics. Consequently, the liquid crystal orientation disturbance does not necessarily occur uniformly from both sides.

In order to reduce image quality deterioration due to the electric field disturbance, the correction processing unit 30 corrects the voltage levels of the drive voltage signals Sig_R, Sig_G, and Sig_B in the following manner, and then supplies the corrected drive voltage signals Sig_R, Sig_G, and Sig_B so as to attain the luminance levels indicated by the image signals, respectively, to the corresponding liquid crystal elements within the liquid crystal display panel 40.

Figure 4:
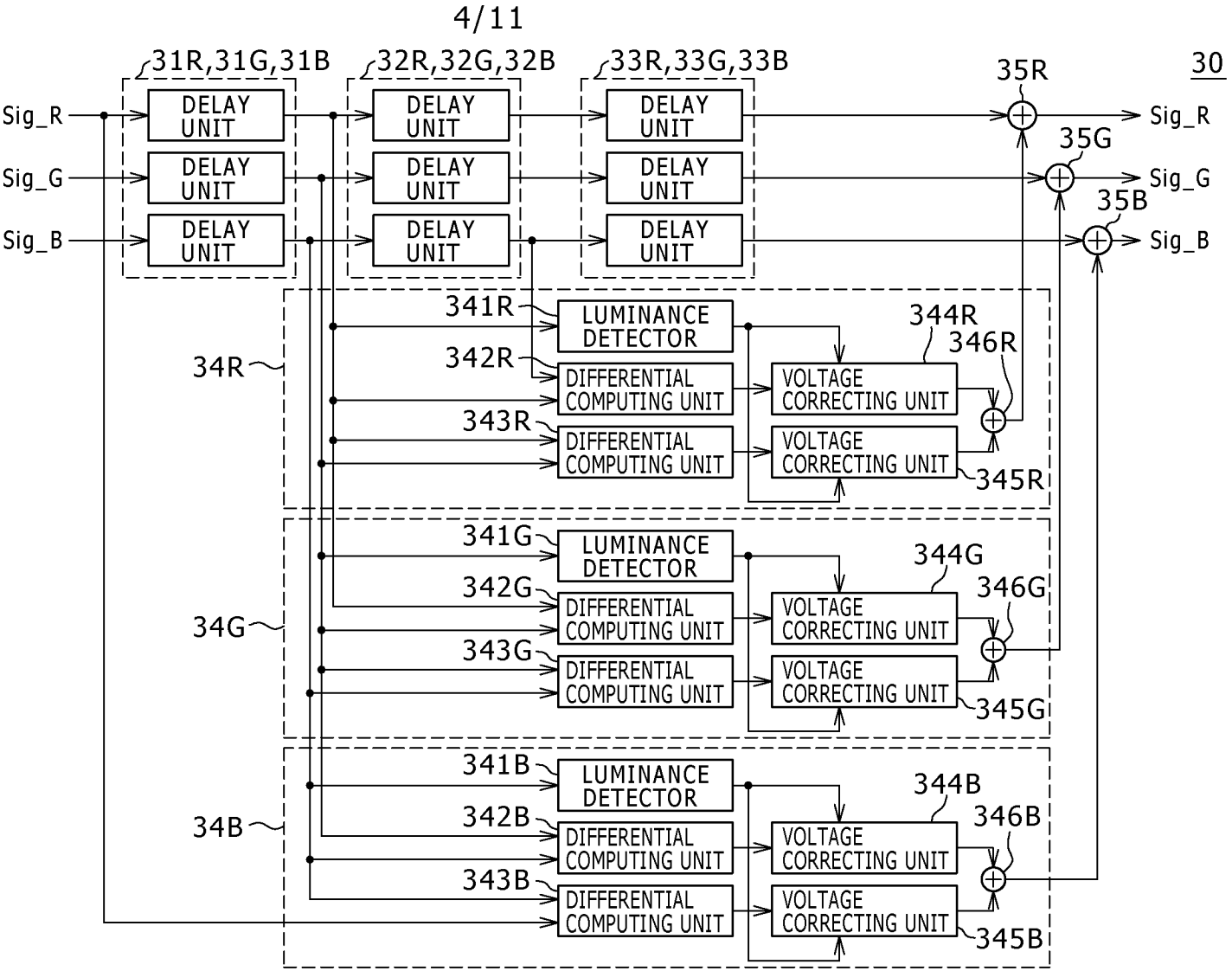
FIG. 4 is a drawing schematically showing the circuit configuration of a correction processing unit.

That is, as shown in FIG. 4, the correction processing unit 30 has (i) delay units 31R, 31G, and 31B to delay the three-phase drive voltage signals Sig_R, Sig_G, and Sig_B to be supplied from the drive voltage signal generator 20, (ii) delay units 32R, 32G, and 32B to further delay the three-phase drive voltage signals Sig_R, Sig_G, and Sig_B that have been delayed by the delay units 31R, 31G, and 31B, respectively, (iii) delay units 33R, 33G, and 33B to further delay the three-phase drive voltage signals Sig_R, Sig_G, and Sig_B that have been delayed by the delay units 32R, 32G, and 32B, respectively, (iv) correction processing circuit groups 34R, 34G, and 34B to compute correction voltage levels for correcting the voltage levels of the drive voltage signals Sig_R, Sig_G, and Sig_B, respectively, and (v) adders 35R, 35G and 35B to add correction voltage levels to the drive voltage signals Sig_R, Sig_G, and Sig_B, respectively.

The delay units 31R, 31G, and 31B give a delay of one cycle of output timing to the drive voltage signals Sig_R, Sig_G, and Sig_B to be supplied from the drive voltage signal generator 20, and then supply the resulting signals to the delay units 32R, 32G, and 32B, respectively.

The delay units 32R, 32G, and 32B give a delay of one cycle of output timing to the drive voltage signals Sig_R, Sig_G, and Sig_B to be supplied from the delay units 31R, 31G, and 31B, and then supply the resulting signals to the delay units 33R, 33G, and 33B, respectively.

The delay units 33R, 33G, and 33B give a predetermined time delay to the drive voltage signals Sig_R, Sig_G, and Sig_B to be supplied from the delay units 32R, 32G, and 32B in order to synchronize with the processing related to the correction processing circuit groups 34R, 34G, and 34B described later, and then supply the resulting signals to the adders 35R, 35G, and 35B, respectively.

The correction processing circuit groups 34R, 34G, and 34B includes a plurality of circuit groups to compute correction voltage levels for correcting the voltage levels of the drive voltage signals Sig_R, Sig_G, and Sig_B.

That is, the correction processing circuit group 34R computes a correction voltage level from the drive voltage signal Sig_R(n) to be supplied to the liquid crystal element R(n), the drive voltage signal Sig_B (n−1) to be supplied to the liquid crystal element B(n−1) adjacent to the liquid crystal element R(n), and the drive voltage signal Sig_G (n) to be supplied to the liquid crystal element G(n) adjacent to the liquid crystal element R(n). Accordingly, the correction processing circuit group 34R includes a luminance detector 341R, two differential computing units 342R, and 343R, two voltage correcting units 344R and 345R, and an adder 346R.

The correction processing circuit group 34G computes a correction voltage level from the drive voltage signal Sig_G (n) to be supplied to the liquid crystal element G(n), the drive voltage signal Sig_R (n) to be supplied to the liquid crystal element R(n) adjacent to the liquid crystal element G(n), and the drive voltage signal Sig_B (n) to be supplied to the liquid crystal element B(n) adjacent to the liquid crystal element G(n). Accordingly, the correction processing circuit group 34G includes luminance detector 341G, two differential computing units 342G and 343G, two voltage correcting units 344G and 345G, and an adder 346G.

The correction processing circuit group 34B computes a correction voltage level from the drive voltage signal Sig_B (n) to be supplied to the liquid crystal element B(n) the drive voltage signal Sig_G (n) to be supplied to the liquid crystal element G(n) adjacent to the liquid crystal element B(n), and the drive voltage signal Sig_R (n+1) to be supplied to the liquid crystal element R(n+1) adjacent to the liquid crystal element B(n). Accordingly, the correction processing circuit group 34B includes a luminance detector 341B, two differential computing units 342B and 343B, two voltage correcting units 344B and 345B, and an adder 346B.

Since these correction processing circuit groups 34R, 34G, and 34B have the same configuration, except for different types of liquid crystal elements to be corrected, only the correction processing circuit group 34R will be further described below.

The luminance detector 341R inputs the drive voltage signal Sig_R(n) to be outputted from the delay unit 31R, and detects, from the drive voltage signal Sig_R(n), the luminance level of a pixel to be displayed by the liquid crystal element R(n), and supplies the detected luminance level to the voltage correcting units 344R and 345R, respectively.

The differential computing unit 342R inputs the drive voltage signal Sig_R(n) to be outputted from the delay unit 31R, and the drive voltage signal Sig_B(n−1) to be outputted from the delay unit 32B, respectively. The differential computing unit 342R computes, as a first voltage level difference, the voltage level difference between the inputted drive voltage signal Sig_R(n) and the inputted drive voltage signal Sig_B (n−1), and supplies the first voltage level difference to the voltage correcting unit 344R.

The differential computing unit 343R inputs the drive voltage signal Sig_R(n) to be outputted from the delay unit 31R, and the drive voltage signal Sig_G(n) to be outputted from the delay unit 31G, respectively. The differential computing unit 343R computes, as a second voltage level difference, the voltage level difference between the inputted drive voltage signal Sig_R(n) and the inputted drive voltage signal Sig_G (n), and supplies the second voltage level difference to the voltage correcting unit 345R.

Figure 5:
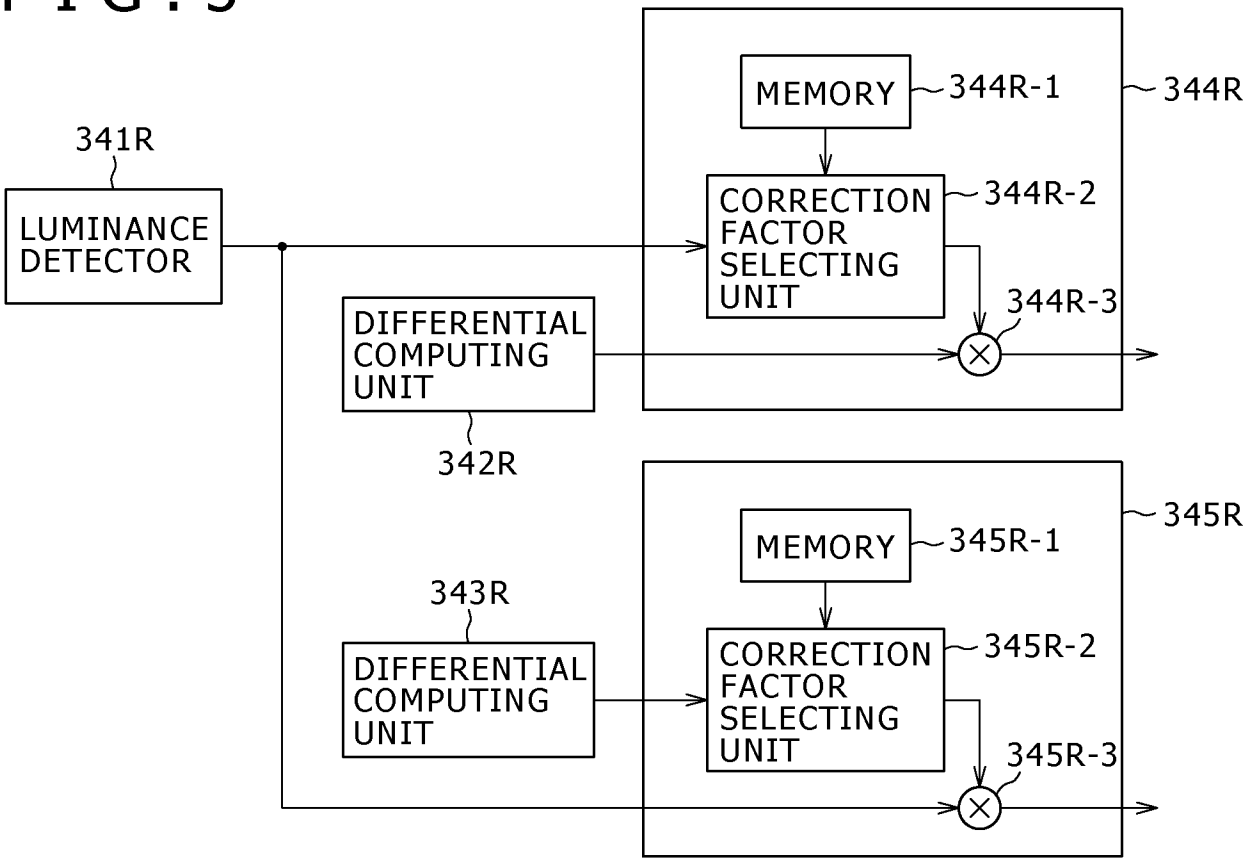
FIG. 5 is a drawing schematically showing the circuit configuration of a correction processing circuit group.

The voltage correcting unit 344R computes a first correction voltage level from a first correction factor Hr1 described later and the first voltage level difference computed by the differential computing unit 342R. Consequently, as shown in FIG. 5, the voltage correcting unit 344R includes (i) a memory 344R-1 to store the first correction factor Hr1 for each of a plurality luminance levels, (ii) a correction factor selecting unit 344R-2 to select the first correction factor Hr1 in accordance with the luminance level detected by the luminance detector 341R from a plurality of the first correction factors Hr1 stored in the memory 344R-1, and (iii) a multiplier 344R-3 that multiplies the first correction factor Hr1 selected by the correction factor selecting unit 344R-2 and the first voltage level difference computed by the differential computing unit 342R, and computes the result of the multiplication as the first correction voltage level.

The voltage correcting unit 345R computes a second correction voltage level from a second correction factor Hr2 described later, and the second voltage level difference computed by the differential computing unit 343R. Consequently, as shown in FIG. 5, the voltage correcting unit 345R includes (i) a memory 345R-1 to store the second correction factor Hr2 for each of a plurality luminance levels, (ii) a correction factor selecting unit 345R-2 to select the second correction factor Hr2 in accordance with the luminance level detected by the luminance detector 341R, from a plurality of the second correction factors Hr2 stored in the memory 345R-1, and (iii) a multiplier 345R-3 that multiplies the second correction factor Hr2 selected by the correction factor selecting unit 345R-2 and the second voltage level difference computed by the differential computing unit 343R, and computes the result of the multiplication as the second correction voltage level.

The adder 346R adds the first correction voltage level computed by the voltage correcting unit 344R and the second correction voltage level computed by the voltage correcting unit 345R, and supplies the resulting level to the adder 35R as a correction voltage level for correcting the voltage level of the drive voltage signal Sig_R.

The correction processing unit 30 having the configuration described above is capable of properly computing a correction voltage level by obtaining the first and second correction factors Hr1 and Hr2 in the following manner, and storing the obtained values in the memories 344R-1 and 345R-1, respectively.

Figure 6A:
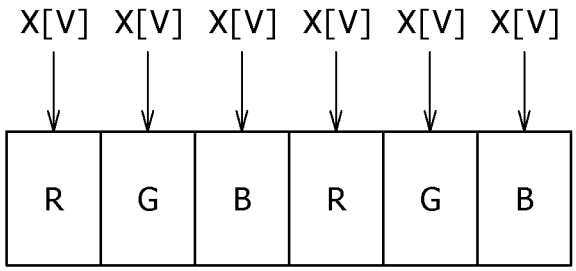
FIGS. 6A, 6B, and 6C are drawings for explaining the computing first and second correction factors, respectively.

Firstly, the luminance level changes of the pixel in accordance with the voltage level of the drive voltage signal supplied to the liquid crystal element as a reference is obtained as follows. That is, the operation characteristics of the respective liquid crystal elements R, G, and B are generally set to the liquid crystal elements arranged along a scanning line of the liquid crystal display panel 40, in order to accurately display white. Accordingly, the luminance level change of the pixel displayed by the liquid crystal element R is detected when X (V) is changed ($0 \leqq X \leqq 5$) in the state where the voltage levels of the drive voltage signals to be supplied to the liquid crystal elements R, G, and B arranged along the scanning line are equal to each other as shown in FIG. 6A. From the result of the detection, the change characteristic serving as the criterion of the liquid crystal element R, which is expressed by the curve C1 connecting the points designated by the symbols ■ in FIG. 7 on which the abscissa represents the voltage level and the ordinate represents the luminance level.

Figure 6B:
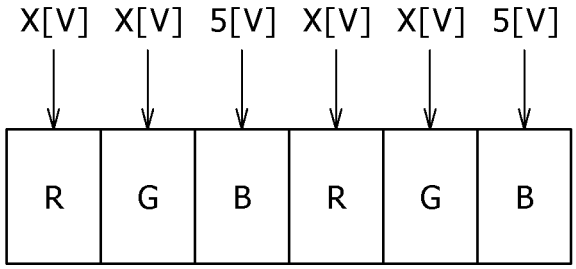

The luminance level change of the pixel displayed by the liquid crystal elements R is detected when X (V) is changed ($0 \leqq X \leqq 5$) in the state where the voltage levels of the drive voltage signals supplied to the liquid crystal elements B is fixed to 5V, and the voltage levels of the drive voltage signals supplied to other liquid crystal elements R and G arranged along the scanning line are equal to each other as shown in FIG. 6B. From the result of the detection, the change characteristic serving as the criterion of the liquid crystal element R, which is expressed by the curve C2 connecting the points designated by the symbols ◆ in FIG. 7 on which the abscissa represents the voltage level difference with the drive voltage signal Sig_B to be supplied to the liquid crystal elements B and the ordinate represents the luminance level.

Figure 6C:
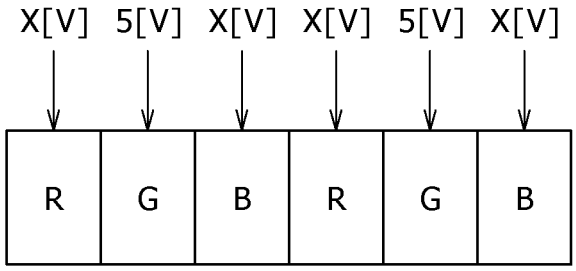

The luminance level change of the pixel displayed by the liquid crystal elements R is detected when X (V) is changed ($0 \leqq X \leqq 5$) in the state where the voltage levels of the drive voltage signals Sig_G supplied to the liquid crystal elements G is fixed to 5V, and the voltage levels of the drive voltage signals supplied to other liquid crystal elements R and B arranged along the scanning line are equal to each other as shown in FIG. 6C. From the result of the detection, the change characteristic serving as the criterion of the liquid crystal element R, which is expressed by the curve C3 connecting the points designated by the symbols ▲ in FIG. 7 on which the abscissa represents the voltage level difference with the drive voltage signal Sig_G supplied to the liquid crystal element G and the ordinate represents the luminance level.

From the operation characteristics of the liquid crystal element R thus obtained, the first and second correction factors Hr1 and Hr2 is obtained in the following manner.

The first correction factor Hr1 is a factor for correcting the luminance level that changes with the voltage level difference from the drive voltage signal Sig_B supplied to the liquid crystal elements B adjacent to the liquid crystal element R in the reverse direction of the scanning line.

Accordingly, based on the relationship obtained by the comparison of the curves C1 and C2, the memory 344R-1 stores the first correction factor Hr1 set in such a manner that the factor value can be increased as the luminance level is lowered.

The second correction factor Hr2 is a factor for correcting the luminance level that will change with the voltage level difference from the drive voltage signal Sig_G supplied to the liquid crystal elements G adjacent to the liquid crystal element R in the forward direction of the scanning line.

Accordingly, based on the relationship obtained by the abovementioned comparison of the curves C1 and C3, the memory 345R-1 stores the second correction factor Hr2 set so that the factor value is increased as the luminance level is lowered.

Figure 7:
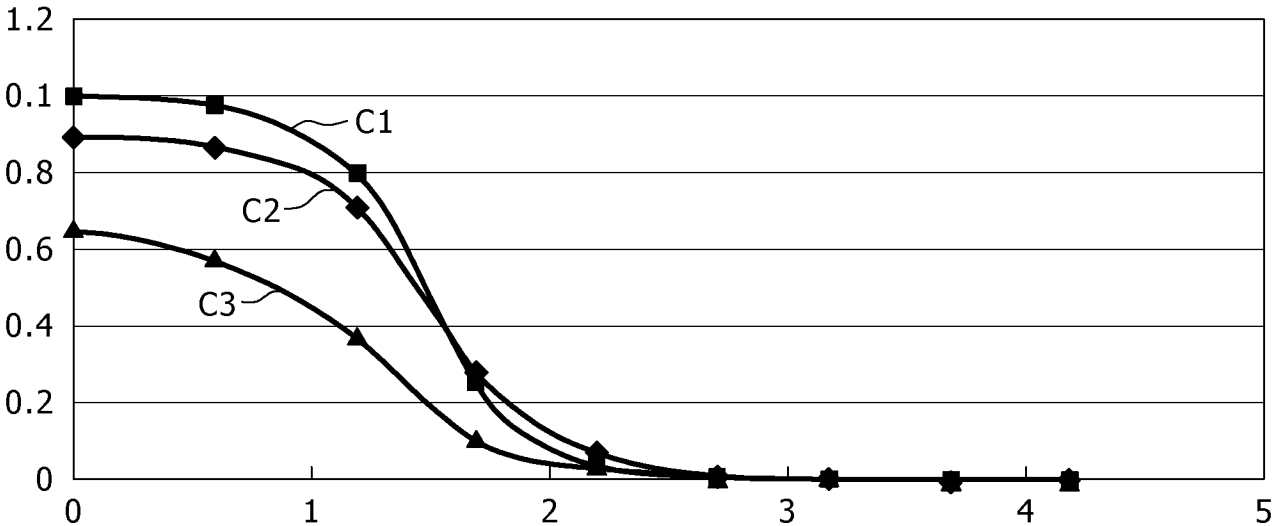
FIG. 7 is a graph for explaining the operation characteristics of liquid crystal elements.
Figure 8:
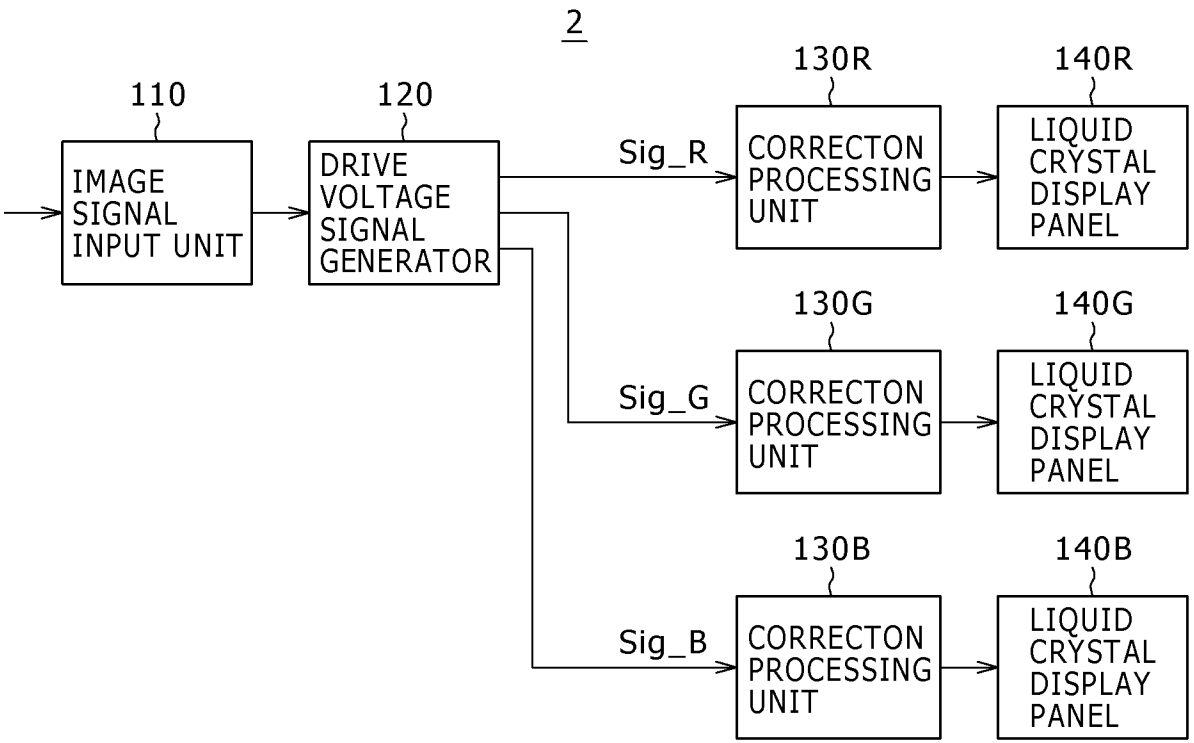
FIG. 8 is a drawing schematically showing the overall configuration of a display apparatus according to other embodiment of the present invention.

Comparing the curve C2 and the curve C3 shown in FIG. 7, the curve C2 has a higher degree of the luminance level drop with respect to the luminance level as a reference expressed by the curve C1, than the curve C3. Because of this, the value of the second correction factor Hr2 is to be set higher than the correction factor Hr1.

Thus, the first and second correction factors Hr1 and Hr2 can be properly obtained and stored in the memories 344R-1 and 345R-1, respectively, by detecting beforehand the degree to which the luminance level drops from the luminance level as a reference.

Even if the degree to which the liquid crystal orientation is disturbed by the voltage level difference between the adjacent liquid crystal elements arranged on the liquid crystal display panel is different depending on whether these liquid crystal elements are adjacent to the forward or reverse direction of the scanning line, the correction processing unit 30 having the configuration described above computes the first correction voltage level from the relationship with the liquid crystal elements adjacent to the forward direction of the scanning line, and the second correction voltage level from the relationship with the liquid crystal elements adjacent to the reverse direction of the scanning line, and then supplies the drive voltage signal of the voltage level obtained by adding the first and second correction voltage levels to the liquid crystal element. This enables proper correction of the luminance level change of the pixel due to the orientation disturbance of the liquid crystal element, thereby reducing image quality deterioration.

Although the liquid crystal display apparatus 1 uses the liquid crystal display panel 40 having the array structure that the liquid crystal elements R, G, and B are respectively provided for each pixel region, any other array structure may be used. That is, the liquid crystal display panel having the array structure that the degree to which the liquid crystal orientation is disturbed by the voltage level difference between the adjacent liquid crystal elements arranged on the liquid crystal display panel is different depending on whether these liquid crystal elements are adjacent to the forward or reverse direction of the scanning line, may be a liquid crystal display panel having the array structure of liquid crystal elements which is laterally asymmetric in the scanning line, and a single plate type liquid crystal display panel having the arrangement of liquid crystal elements to control the liquid crystal orientation including the tilt angle. With respect to these display panels, the correction processing unit 30 can also properly correct the luminance level change due to the liquid crystal orientation disturbance. This enables to reduce image quality deterioration of images displayed on the liquid crystal display panel.

Next, a liquid crystal display apparatus according to other embodiment will be described. A liquid crystal display apparatus 2 includes a three-plate type liquid crystal display panel composed of a liquid crystal display panel 140R in which only a plurality of liquid crystal elements R are arranged, a liquid crystal display panel 140G in which only a plurality of liquid crystal elements G are arranged, and a liquid crystal display panel 140B in which only a plurality of liquid crystal elements B are arranged.

For supplying the drive voltage signals Sig_R, Sig_G, and Sig_B to the liquid crystal display panels 140R, 140G, and 140B, respectively, the liquid crystal display apparatus 2 has an image signal input unit 110 to input image signals from the outside, a drive voltage signal generator 120 to generate a drive voltage signal for driving the liquid crystal elements in accordance with image signals, and correction processing units 130R, 130G, and 130B to correct the voltage levels of the drive voltage signals, respectively.

The image signal input unit 110 inputs from the outside, for example, via a predetermined interface, image signals in a digital format, and supplies the input image signal to the drive voltage signal generator 120.

The drive voltage signal generator 120 generates three-phase drive voltage signals Sig_R, Sig_G, and Sig_B from the image signals supplied from the image signal input unit 110, in order to simultaneously drive the liquid crystal elements arranged on the liquid crystal display panels 140R, 140G, and 140B. The drive voltage signal generator 120 then supplies these generated signals as follows: the drive voltage signal Sig_R to the correction processing unit 130R, the drive voltage signal Sig_G to the correction processing unit 130GR, and the drive voltage signal Sig_B to the correction processing unit 130B.

The correction processing units 130R, 130G, and 130B perform correction processing described later to the drive voltage signals Sig_R, Sig_G, and Sig_B supplied from the drive voltage signal generator 120, respectively, and then supply the corrected drive voltage signals Sig_R, Sig_G, and Sig_B to the liquid crystal display panels 140R, 140G, and 140B, respectively.

In the liquid crystal display apparatus 2 having the above configuration, the operations related to the liquid crystal display panels 140R, 140G, and 140B are identical, except that the light wavelength region is different. Therefore, the following description will be made of the step of performing the correction processing to the voltage level of the drive voltage signal Sig_G supplied to the liquid crystal display panel 140G.

Figure 9:
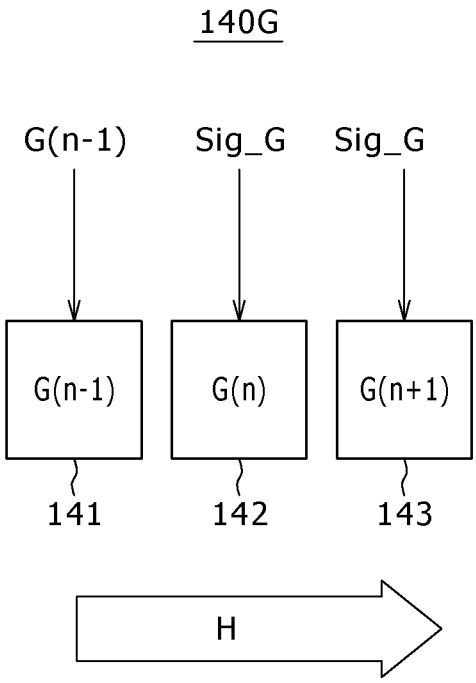
FIG. 9 is a drawing schematically showing the array configuration of liquid crystal elements arranged on a three-plate type liquid crystal display panel.

In the three-plate type liquid crystal display panel, the liquid crystal display panel 140G is a panel for displaying green light, in which pixel regions 141, 142, and 143 are arranged along the forward direction H of a predetermined scanning line, as shown in FIG. 9. The pixel regions 141, 142, and 143 includes liquid crystal elements G(n−1), G(n), and G(n+1), respectively.

In the liquid crystal display panel 140G with the liquid crystal elements G provided within the respective pixel regions, the drive voltage signal Sig_G (n−1) is supplied from the drive voltage signal generator 120 to the element G(n−1) at a first timing, the drive voltage signal Sig_G(n) is supplied from the drive voltage signal generator 120 to the element G(n) at a second timing, and the drive voltage signal Sig_G (n+1) is supplied from the drive voltage signal generator 120 to the element G(n+1) at a third timing.

The liquid crystal display panel 140G, in which the drive voltage signals Sig_G(n−1), Sig_G(n), and Sig_(n+1) are supplied to their respective liquid crystal elements G(n−1), G(n), and G(n+1) in this manner, is capable of displaying the image indicated by image signals upon the supply of these drive voltage signals to the respective liquid crystal elements.

Similarly to the single plate type liquid crystal display panel 40, for example, the liquid crystal element G(n) is focused attention. In the liquid crystal element G(n), the liquid crystal orientation thereof will be disturbed by the voltage level difference with the drive voltage signals supplied to the adjacent liquid crystal elements G(n−1) and G(n+1), failing to drive so as to achieve the desired luminance level.

Figure 10:
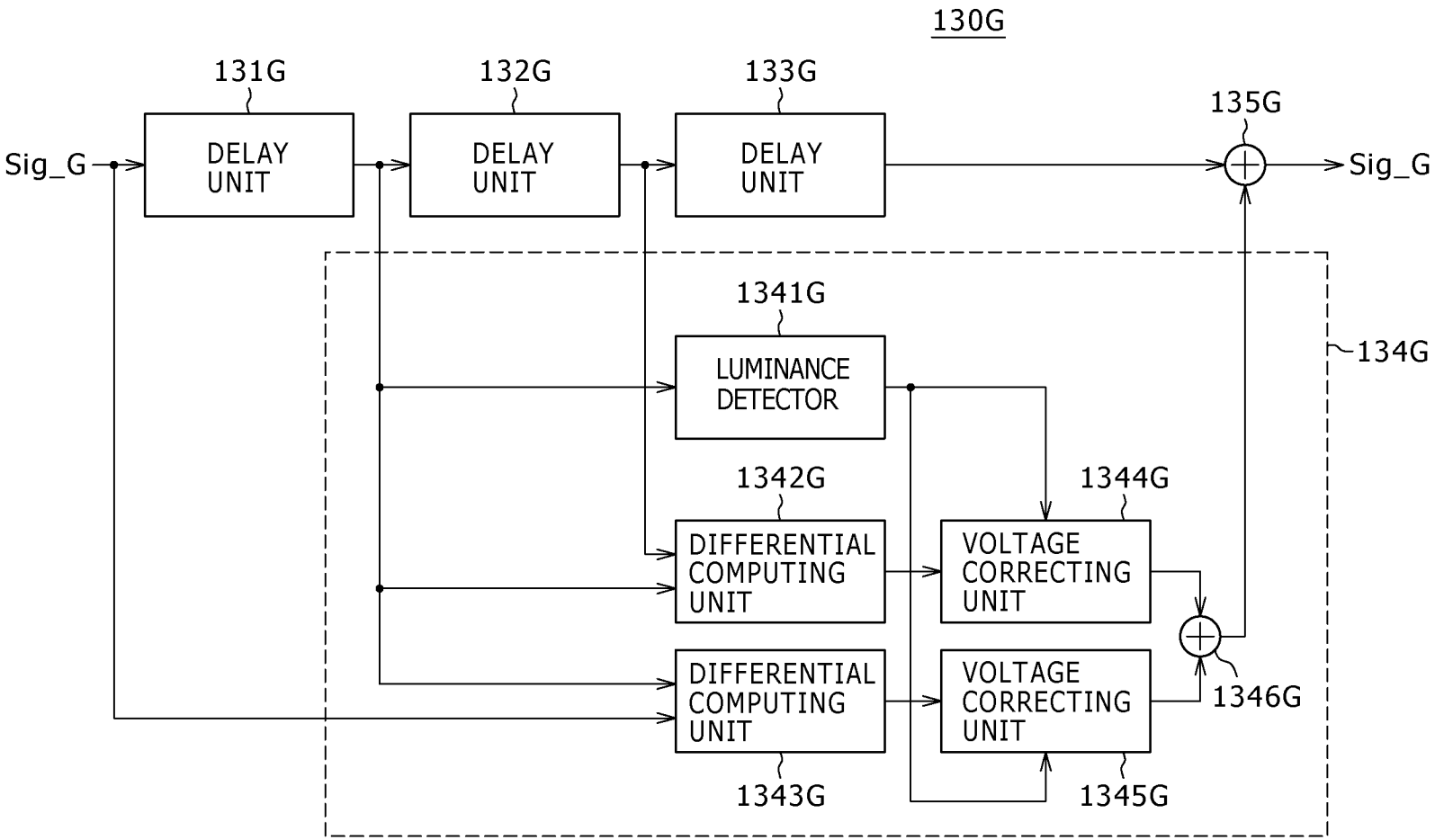
FIG. 10 is a drawing schematically showing the circuit configuration of a correction processing unit of the display apparatus of other embodiment.
Figure 11A:
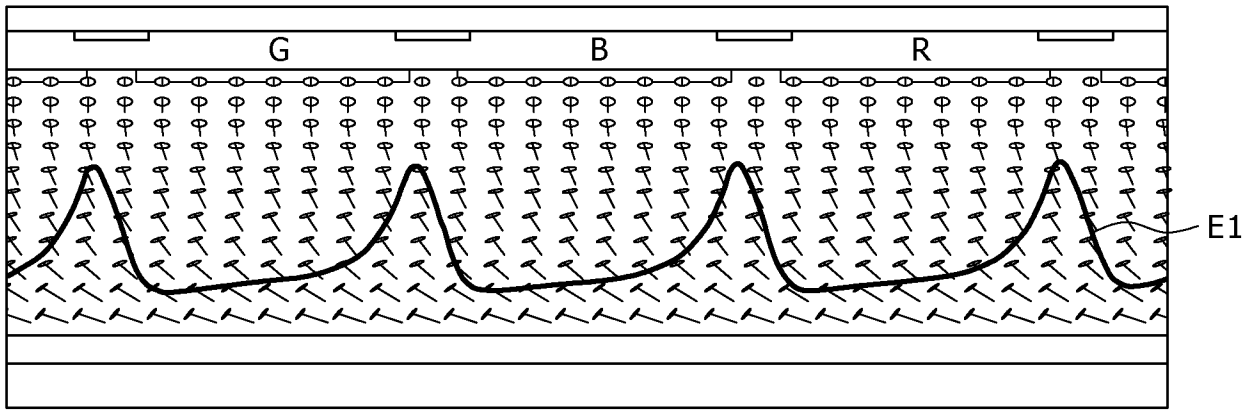
FIGS. 11A and 11B are drawings schematically showing the situations where the liquid crystal orientation is disturbed by the voltage level difference between drive voltage signals supplied to adjacent liquid crystal elements, respectively.
Figure 11B:
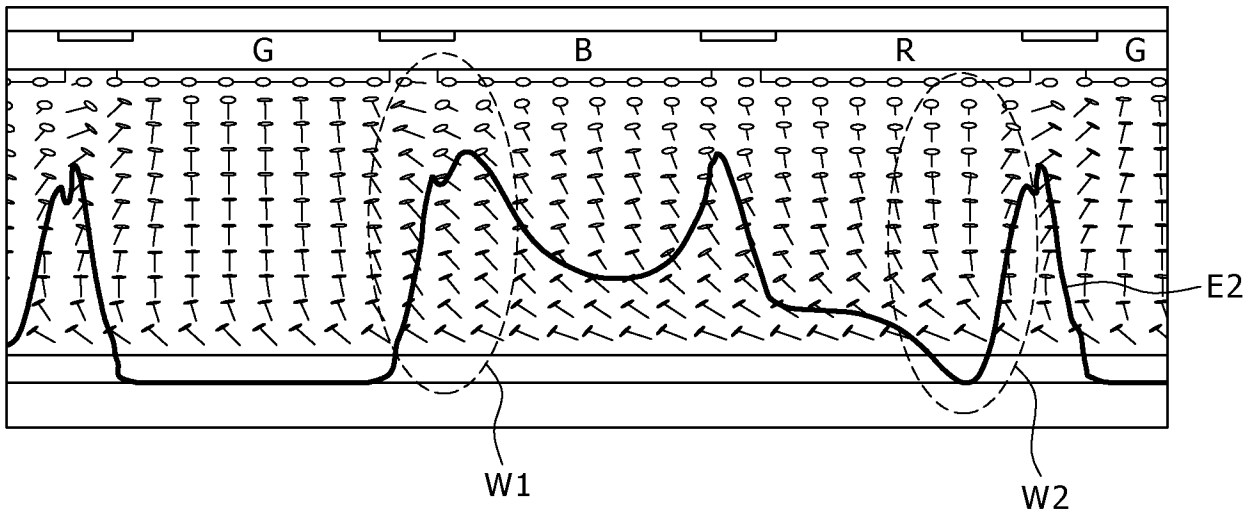

For correcting the luminance level change due to the liquid crystal orientation disturbance, as shown in FIG. 10, the correction processing unit 130 has (i) a delay unit 131G to delay the drive voltage signal Sig_G to be supplied from the drive voltage signal generator 120, (ii) a delay unit 132G to further delay the drive voltage signal Sig_G that has been delayed by the delay unit 131G, (iii) a delay unit 133G to further delay the drive voltage signal Sig_G that has been delayed by the delay unit 132G, (iv) a correction processing circuit group 134G to compute a correction voltage level for correcting the voltage level of the drive voltage signal Sig_G, and (v) an adder 135G to add the correction voltage level to the voltage level of the drive voltage signal Sig_G outputted from the delay unit 133G.

The delay unit 131G gives a delay of one cycle of output timing to the drive voltage signal Sig_G supplied from the drive voltage signal generator 120.

The delay unit 132G gives a delay of one cycle of output timing to the drive voltage signal Sig_G outputted from the delay unit 131G, and then supplies the resulting signal to the delay unit 133G.

The delay unit 133G gives a predetermined time delay to the drive voltage signal Sig_G supplied from the delay unit 132G in order to synchronize with the processing related to the correction processing circuit group 134G described later, and then supplies the resulting signal to the adder 135G.

The correction processing circuit group 134G includes a luminance detector 1341G, two differential computing units 1342G and 1343G, two voltage correcting units 1344G and 1345G, and an adder 1346G, in order to compute a correction voltage level from the drive voltage signal Sig_G(n) of the liquid crystal element G(n) to be corrected, the drive voltage signal Sig_G(n−1) of the liquid crystal element G(n−1) adjacent to the liquid crystal element G (n), and the drive voltage signal Sig_G(n+1) of the liquid crystal element G(n+1) adjacent to the liquid crystal element G(n).

The luminance detector 1341G inputs the drive voltage signal Sig_G(n) outputted from the delay unit 131G, and detects, from the drive voltage signal Sig_G(n), the luminance level of a pixel displayed by the liquid crystal element G(n), and supplies the detected luminance level to the voltage correcting units 1344G and 1345G, respectively.

The differential computing unit 1342G inputs the drive voltage signal Sig_G(n) outputted from the delay unit 131G, and the drive voltage signal Sig_G(n−1) outputted from the delay unit 132G, respectively. The differential computing unit 1342G then computes, as a first voltage level difference, the voltage level difference between the inputted drive voltage signal Sig_G(n) and the inputted drive voltage signal Sig_G(n−1), and supplies the first voltage level difference to the voltage correcting unit 1344G.

The differential computing unit 1343G inputs the drive voltage signal Sig_G(n) to be outputted from the delay unit 131G, and the drive voltage signal Sig_G(n+1) supplied from the drive voltage signal generator 120, respectively. The differential computing unit 1343G then computes, as a second voltage level difference, the voltage level difference between the inputted drive voltage signal Sig_G(n) and the inputted drive voltage signal Sig_G(n+1), and supplies the second voltage level difference to the voltage correcting unit 1345G.

The voltage correcting unit 1344G computes a first correction voltage level from a first correction factor Hg1 selected from a predetermined memory in accordance with the luminance level detected by the luminance detector 1341G and the first voltage level difference computed by the differential computing unit 1342G.

The first correction factor Hg1 to be stored in the memory provided in the voltage correcting unit 1344G is a value set based on the result obtained by detecting beforehand the luminance level change of the pixel displayed by the liquid crystal element G(n) in accordance with the voltage level of the drive voltage signal to be supplied to the liquid crystal element G(n) in the state in which a drive voltage signal having a predetermined voltage level is supplied to the liquid crystal element G(n−1).

The voltage correcting unit 1345G computes a second correction voltage level from a second correction factor Hg2 selected from a predetermined memory in accordance with the luminance level detected by the luminance detector 1341G and the second voltage level difference computed by the differential computing unit 1343G.

The second correction factor Hg2 to be stored in the memory provided in the voltage correcting unit 1345G is a value set based on the result obtained by detecting beforehand the luminance level change of the pixel displayed by the liquid crystal element G(n) in accordance with the voltage level of the drive voltage signal to be supplied to the liquid crystal element G(n) in the state in which a drive voltage signal having a predetermined voltage level is supplied to the liquid crystal element G(n+1).

The adder 1346G adds the first correction voltage level computed by the voltage correcting unit 1344G and the second correction voltage level computed by the voltage correcting unit 1345G, and supplies the resulting level to the adder 135G as a voltage level for correcting the voltage level of the drive voltage signal Sig_G(n).

Even when the degree to which the liquid crystal orientation is disturbed by the voltage level difference between the adjacent liquid crystal elements arranged on the liquid crystal display panel is different depending on whether these liquid crystal elements are adjacent to the forward or reverse direction of the scanning line, the correction processing unit 130G having the configuration described above computes the first correction voltage level from the relationship with the liquid crystal element adjacent to the forward direction of the scanning line, and the second correction voltage level from the relationship with the liquid crystal element adjacent to the reverse direction of the scanning line, and supplies the drive voltage signal of the voltage level obtained by adding the first and second correction voltage levels, to the liquid crystal element. This enables proper correction of the luminance level change of the pixel due to the orientation disturbance of the liquid crystal element, thereby reducing image quality deterioration.

The signal processing device, to which an embodiment of the present invention is applied, is not limited to the embodiment incorporating the display apparatus provided with the liquid crystal panel in which liquid crystal elements are arranged along the scanning line in order to cause liquid crystal held between the opposing substrates to be oriented by the voltage applied to the liquid crystal.

That is, in the case of incorporating a display panel in which a plurality of display elements are arranged along a predetermined scanning line, and the luminance level displayed by a display element changes depending on the signal level of a drive voltage signal supplied to the adjacent display element, the signal processing device, to which an embodiment of the present invention is applied, can properly correct the luminance level of the pixel displayed by the display element, thereby reducing image quality deterioration, as described above.

Specifically, the signal processing device, to which an embodiment of the present invention is applied, can also achieve reduction of image quality deterioration in, for example, the embodiment incorporating an organic electroluminescence (EL) display panel having two opposing substrates with electrodes, at least one of the substrates being transparent, and holding organic matter between these two substrates, in which display elements composed of this organic substance are caused to emit light upon the application of a drive voltage signal to these display elements.

It is noted that the specific forms and structures of the various parts and the numeric values indicated in each of the embodiments and the above numeral examples are merely given as examples for implementation of embodiments of the present invention. It is therefore to be understood that the technical scope of the present invention should in no way be limited by the above.

What is claimed is:

1. A signal processing device for supplying a drive voltage signal to a display panel, the display panel including two substrates which oppose each other, electrodes disposed on the respective two substrates, and a plurality of display elements arranged along a scanning line and driven by the drive voltage signal supplied to the electrodes, at least one of the two substrates being transparent, the signal processing device comprising:

input means for inputting the drive voltage signal;

luminance detecting means for detecting, from a drive voltage signal supplied to a display element inputted by the input means, a luminance level of a pixel displayed by the display element;

means for storing a first correction factor for correcting the luminance level of the pixel to be changed by a voltage level difference between a drive voltage signal supplied to the display element and a drive voltage signal supplied to a first adjacent display element adjacent to the display element in a forward direction of the scanning line, and a second correction factor for correcting the luminance level of the pixel to be changed by a voltage level difference between a drive voltage signal supplied to the display element and a second adjacent display element adjacent to the display element in a reverse direction of the scanning line;

selecting means for selecting from the storing means a first correction factor and a second correction factor in accordance with a luminance level of a pixel detected by the luminance detecting means;

differential computing means for computing, from a drive voltage signal inputted by the input means, a first voltage level difference indicating a voltage level difference between a drive voltage signal supplied to the display element and a drive voltage signal supplied to the first adjacent display element, and a second voltage level difference indicating a voltage level difference between a drive voltage signal supplied to the display element and a drive voltage signal supplied to the second adjacent display element;

correction voltage level computing means for computing a first correction voltage level from the first correction factor selected by the selecting means and the first voltage level difference computed by the differential computing means, and a second correction voltage level from the second correction factor selected by the selecting means and the second voltage level difference computed by the differential computing means; and means for adding the first correction voltage level and the second correction voltage level computed by the correction voltage level computing means to the voltage level of a drive voltage signal to be supplied to the display element inputted by the input means, and supplying the resulting level to the display element of the display panel.

2. The signal processing device according to claim 1, wherein the display panel has two opposing electrodes provided with electrodes, at least one of the substrates being transparent, and the plurality of display elements with liquid crystal held between the opposing substrates, and is driven by the drive voltage signal applied to the liquid crystal.

3. The signal processing device according to claim 1, wherein the display panel includes, in each of pixel regions arranged along the scanning line, a pixel composed of a display element for displaying green light, a display element for displaying red light, and a display element for displaying blue light.

4. The signal processing device according to claim 1, wherein the first correction factor stored in the storing means is set based on the luminance level change of the pixel in accordance with the voltage level of a drive voltage signal supplied to the display element when a drive voltage signal having a predetermined voltage level is supplied to the first adjacent display element, and the second correction factor stored in the storing means is set based on the luminance level change of the pixel in accordance with the voltage level of a drive voltage signal supplied to the display element when a drive voltage signal having a predetermined voltage level is supplied to the second adjacent display element.

5. The signal processing device according to claim 1, wherein the correction voltage level computing means computes the first correction voltage level by multiplying the first correction factor and the first voltage level difference, and computes the second correction voltage level by multiplying the second correction factor and the second voltage level difference.

6. A signal processing method of supplying a drive voltage signal to a display panel, the display panel including two substrates which oppose each other, electrodes disposed on the respective two substrates, and a plurality of display elements arranged along a scanning line and driven by the drive voltage signal supplied to the electrodes, at least one of the two substrates being transparent, the method comprising the steps of:

inputting the drive voltage signal by input means;

detecting, from a drive voltage signal to be supplied to a display element inputted by the inputting step, a luminance level of the pixel displayed by the display element;

selecting a first correction factor and a second correction factor in accordance with the luminance level of a pixel detected by the luminance level detecting step, from a memory storing a first correction factor for correcting the luminance level of the pixel to be changed by a voltage level difference between a drive voltage signal supplied to the display element and a drive voltage signal supplied to a first adjacent display element adjacent to the display element in a forward direction of the scanning line, and a second correction factor for correcting the luminance level of the pixel to be changed by a voltage level difference between a drive voltage signal supplied to the display element and a second adjacent display element adjacent to the display element in a reverse direction of the scanning line;

computing, from a drive voltage signal inputted by the input means, a first voltage level difference indicating a voltage level difference between a drive voltage signal to be supplied to the display element and a drive voltage signal supplied to the first adjacent display element, and a second voltage level difference indicating a voltage level difference between a drive voltage signal supplied to the display element and a drive voltage signal supplied to the second adjacent display element;

computing a first correction voltage level from the first correction factor selected by the selecting step and the first voltage level difference computed by the differential computing step, and a second correction voltage level from the second correction factor selected by the select step and the second voltage level difference computed by the differential computing step; and adding the first correction voltage level and the second correction voltage level computed by the correction voltage level computing step, to the voltage level of a drive voltage signal supplied to the display element inputted by the input means, and supplying the resulting level to the display element of the display panel.

7. A method of processing a drive voltage signal to be supplied to a display device, the display device including a display panel which includes two substrates which oppose each other, electrodes disposed on the respective two substrates, and a plurality of display elements arranged along a scanning line and driven by the drive voltage signal supplied to the electrodes, at least one of the two substrates being transparent, the method comprising the signal processing method according to claim 6.

8. A display apparatus comprising:

a display panel including two substrates which oppose each other, at least one of the two substrate being transparent;

electrodes disposed on the respective two substrates;

a plurality of display elements arranged along a scanning line and driven by a drive voltage applied to the electrodes; and a signal processing device to supply the drive voltage signal to the display panel, wherein the signal processing device includes:

input means for inputting the drive voltage signal;

luminance detecting means for detecting, from a drive voltage signal supplied to a display element inputted by the input means, a luminance level of a pixel displayed by the display element;

means for storing a first correction factor for correcting the luminance level of the pixel to be changed by a voltage level difference between a drive voltage signal supplied to the display element and a drive voltage signal supplied to a first adjacent display element adjacent to the display element in a forward direction of the scanning line, and a second correction factor for correcting the luminance level of the pixel to be changed by a voltage level difference between a drive voltage signal supplied to the display element and a second adjacent display element adjacent to the display element in a reverse direction of the scanning line;

selecting means for selecting from the storing means a first correction factor and a second correction factor in accordance with a luminance level of a pixel detected by the luminance detecting means;

differential computing means for computing, from a drive voltage signal inputted by the input means, a first voltage level difference indicating a voltage level difference between a drive voltage signal supplied to the display element and a drive voltage signal supplied to the first adjacent display element, and a second voltage level difference indicating a voltage level difference between a drive voltage signal supplied to the display element and a drive voltage signal supplied to the second adjacent display element;

correction voltage level computing means for computing a first correction voltage level from the first correction factor selected by the selecting means and the first voltage level difference computed by the differential computing means, and a second correction voltage level from the second correction factor selected by the selecting means and the second voltage level difference computed by the differential computing means; and means for adding the first correction voltage level and the second correction voltage level computed by the correction voltage level computing means to the voltage level of a drive voltage signal to be supplied to the display element inputted by the input means, and supplying the resulting level to the display element of the display panel.

9. A signal processing device for supplying a drive voltage signal to a display panel, the display panel having two substrates which oppose each other, electrodes disposed on the respective two substrates, and a plurality of display elements arranged along a scanning line and driven by the drive voltage signal supplied to the electrodes, at least one of the two substrates being transparent, the signal processing device comprising:

an input unit to input the drive voltage signal;

a luminance detector to detect, from a drive voltage signal supplied to a display element inputted by the input unit, a luminance level of a pixel displayed by the display element;

a memory to store a first correction factor for correcting the luminance level of the pixel to be changed by a voltage level difference between a drive voltage signal supplied to the display element and a drive voltage signal supplied to a first adjacent display element adjacent to the display element in a forward direction of the scanning line, and a second correction factor for correcting the luminance level of the pixel to be changed by a voltage level difference between a drive voltage signal supplied to the display element and a second adjacent display element adjacent to the display element in a reverse direction of the scanning line;

a selector to select from the memory a first correction factor and a second correction factor in accordance with a luminance level of a pixel detected by the luminance detector;

a differential computing unit to compute, from a drive voltage signal inputted by the input unit, a first voltage level difference indicating a voltage level difference between a drive voltage signal supplied to the display element and a drive voltage signal supplied to the first adjacent display element, and a second voltage level difference indicating a voltage level difference between a drive voltage signal supplied to the display element and a drive voltage signal supplied to the second adjacent display element;

a correction voltage level computing unit to compute a first correction voltage level from the first correction factor selected by the selector and the first voltage level difference computed by the differential computing unit, and a second correction voltage level from the second correction factor selected by the selector and the second voltage level difference computed by the differential computing unit; and an adder to add the first correction voltage level and the second correction voltage level computed by the correction voltage level computing unit to the voltage level of a drive voltage signal to be supplied to the display element inputted by the input unit, and supplying the resulting level to the display element of the display panel.

10. A display apparatus comprising:

a display panel including two substrates which oppose each other, at least one of the two substrates being transparent;

electrodes disposed on the respective two substrates;

a plurality of display elements arranged along a scanning line and driven by a drive voltage applied to the electrodes; and a signal processing device to supply the drive voltage signal to the display panel, wherein the signal processing device includes:

an input unit to input the drive voltage signal;

a luminance detector to detect, from a drive voltage signal supplied to a display element inputted by the input unit, a luminance level of a pixel displayed by the display element;

a memory to store a first correction factor for correcting the luminance level of the pixel to be changed by a voltage level difference between a drive voltage signal supplied to the display element and a drive voltage signal supplied to a first adjacent display element adjacent to the display element in a forward direction of the scanning line, and a second correction factor for correcting the luminance level of the pixel to be changed by a voltage level difference between a drive voltage signal supplied to the display element and a second adjacent display element adjacent to the display element in a reverse direction of the scanning line;

a selector to select from the memory a first correction factor and a second correction factor in accordance with a luminance level of a pixel detected by the luminance detector;

a differential computing unit to compute, from a drive voltage signal inputted by the input unit, a first voltage level difference indicating a voltage level difference between a drive voltage signal supplied to the display element and a drive voltage signal supplied to the first adjacent display element, and a second voltage level difference indicating a voltage level difference between a drive voltage signal supplied to the display element and a drive voltage signal supplied to the second adjacent display element;

a correction voltage level computing unit to compute a first correction voltage level from the first correction factor selected by the selector and the first voltage level difference computed by the differential computing unit, and a second correction voltage level from the second correction factor selected by the selector and the second voltage level difference computed by the differential computing unit; and an adder to add the first correction voltage level and the second correction voltage level computed by the correction voltage level computing unit to the voltage level of a drive voltage signal to be supplied to the display element inputted by the input unit, and supplying the resulting level to the display element of the display panel.

* * * * *